United States Patent [19]

Mitanihara et al.

[11] Patent Number: 4,836,873

[45] Date of Patent: Jun. 6, 1989

[54] AUTOMATIC PACKAGING METHOD AND APPARATUS

[75] Inventors: Makoto Mitanihara; Tatsuo Sekine, both of Saitama, Japan

[73] Assignee: Kabushiki Kaisha Sato, Japan

[21] Appl. No.: 90,745

[22] Filed: Aug. 28, 1987

[30] Foreign Application Priority Data

Aug. 29, 1986 [JP] Japan ..... 61-201227

[51] Int. Cl.[4] ..... B65B 13/04; B65B 13/32; B65B 57/10

[52] U.S. Cl. ..... 156/157; 53/399; 53/582; 100/2; 100/4; 100/26; 100/33 PB; 156/212; 156/353; 156/358; 156/361; 156/468; 156/495; 156/499; 156/502

[58] Field of Search ..... 156/73.5, 212, 495, 156/580, 157, 502, 353, 358, 361, 468, 499; 100/4, 25, 26, 33 PB, 2; 53/399, 582

[56] References Cited

U.S. PATENT DOCUMENTS

| | | | |
|---|---|---|---|
| 1,357,883 | 11/1920 | McChesney | 100/2 |
| 3,146,694 | 9/1964 | Staron et al. | 100/2 |
| 3,215,064 | 11/1965 | Koehler | 100/4 |
| 3,442,732 | 5/1969 | Stensaker et al. | 53/399 |
| 3,442,735 | 5/1969 | Stensaker | 156/73.5 |
| 3,447,447 | 6/1969 | Rutty | 100/4 |
| 3,493,018 | 2/1970 | Otto | 100/25 |
| 3,494,280 | 2/1970 | Kobiella | 100/2 |
| 3,554,844 | 1/1971 | Ingram | 156/522 |
| 3,566,778 | 3/1971 | Vilcins | 100/2 |
| 3,636,861 | 1/1971 | Weller | 100/4 |
| 3,691,939 | 9/1972 | Goodley | 100/2 |
| 3,718,526 | 2/1973 | Annis Jr. | 156/580 |
| 3,858,503 | 1/1975 | Takahashi | 100/33 PB |
| 3,875,855 | 4/1975 | Clark et al. | 100/2 |
| 3,916,779 | 11/1975 | Gutjahr et al. | 100/26 |
| 3,946,659 | 3/1976 | Gutjahr et al. | 100/4 |
| 4,062,278 | 12/1977 | Cheung | 100/4 |
| 4,077,313 | 3/1978 | Lems et al. | 100/2 |
| 4,079,667 | 3/1978 | Lems et al. | 100/26 |
| 4,378,262 | 3/1983 | Annis Jr. | 156/73.5 |
| 4,443,288 | 4/1984 | Sawada et al. | 156/580 |
| 4,527,379 | 7/1985 | Bartzick et al. | 53/582 |

FOREIGN PATENT DOCUMENTS

| | | |
|---|---|---|
| 1153318 | 8/1963 | Fed. Rep. of Germany . |
| 2403261 | 7/1975 | Fed. Rep. of Germany . |
| 49-4520 | 2/1974 | Japan . |
| 388182 | 6/1965 | Switzerland . |
| 391013 | 7/1973 | U.S.S.R. . |
| 936718 | 9/1963 | United Kingdom . |

*Primary Examiner*—Michael Wityshyn

*Attorney, Agent, or Firm*—Ostrolenk, Faber, Gerb & Soffen

[57] ABSTRACT

An automatic binding apparatus produces a loop of tape and tightens the tape around an object that is inserted through the loop of tape. The apparatus has a bed-plate and a guide member which is swivelable into position on and off the bed-plate. Initially, the tape is guided through the guide member to form a small loop of tape. Thereafter the guide member is retracted and the loop of tape is enlarged by feeding more tape to the loop to accommodate large objects. Insertion of the object through the loop actuates a work detection switch and detection of the object produces an output signal which triggers a process whereby the tape is tightly bound around the object, is cut from the tape supply, and the ends of the tape are overlapped and pressure welded to one another. Removal of the bound object changes the state of the work detection switch and results in the repositioning of the guide member over the bed-plate and in the formation of a fresh loop of tape for a next object to be bound.

17 Claims, 10 Drawing Sheets

FIG. 6.
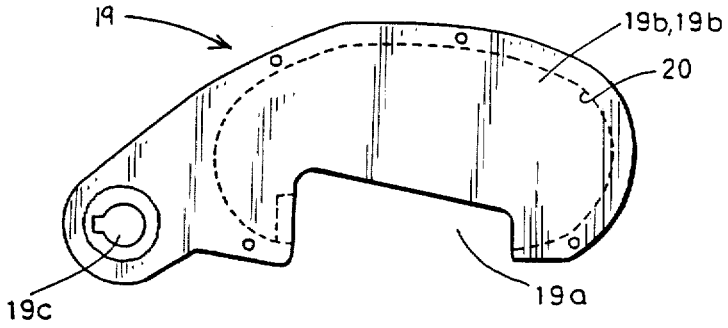
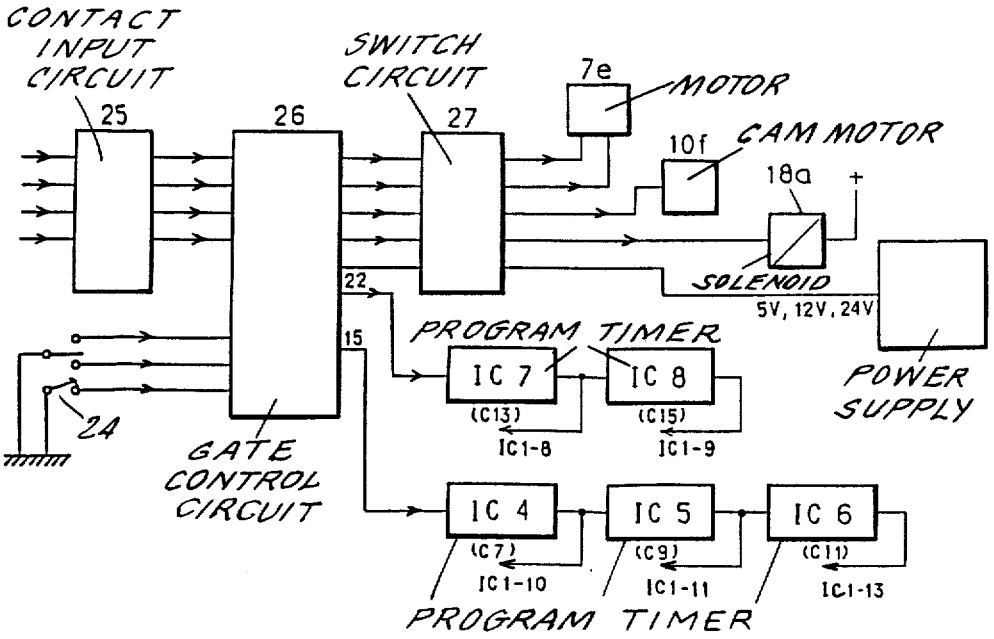
FIG. 7.

AUTOMATIC PACKAGING METHOD AND APPARATUS

BACKGROUND OF THE INVENTION

The present invention relates to an automatic packaging apparatus and, more particularly, to a device for binding packages with a band of tape made of thermoplastic material such as polypropylene.

Various devices for binding packages with packaging tape are known. The known devices have a work table on which an arc-shaped tape guide member is provided for forming a loop of tape by winding the tape through the guide member. The object to be bound is inserted through the loop of tape and the guide member and then the tape is tighten around the object. Devices of the above-mentioned type suffer from the drawback that the object is inserted through the guide member. This limits the size of packages that can be handled to the size of the guide member.

A partial solution is offeref by Japanese Patent publication No. 49 (1974)-4520 which describes a retractable arc-shaped guide member which is located on a work table. The packing tape is fed from below a base plate of the work table along and through the guide member. After the tape passes through the guide member, the leading end of the tape is clamped and the guide member is retracted. This leaves an initial loop of tape in place. Thereafter, more of the tape is paid out to enlarge the size of the loop to accommodate larger packages. After a package is inserted through the loop, the tape is tightened around the package and the ends of the tape are overlapped and joined and the excess cut off.

The above-mentioned retractable guide member still fails to provide the full desired functionality for a guide member. This is due in part to the positioning of the guide member at such a loctaion where it would not obstruct or interfere with the operation of an associated moving means which are provided for moving the tape.

Moreover, the guide member of the Japanese reference is designed to be temporarily retracted beneath the work table surface. It is therefore implemented from two, roughly symmetrical, guide pieces. This requries open spaces on each side of a guide fixing postion on the work table surface and the two pieces of the guide member had to be constructed with great mechanical precision to prevent tangling of the tape. In fact, the structure of the guide member of the above mentioned prior art is such that even its precise mechanical construction does not prevent the tape from falling out of the guide groove in the guide member or mfrom catching in the groove.

U.S. Pat. No. 4,378,262 describes a method and apparatus for forming a strap loop and securing it about an article. The strap is formed with the aid of a guide surface which, in one embodiment, is formed of a rotatable cam. After a primary small strap is formed with the aid of the cam, the strap is removed from the guide sursface, enlarged, and then tightened around an article.

U.S. Pat. Nos. 4,079,667 and 4,077,313 describe several embodiments for forming and tensioning a strap about an object including forming a primary strap loop by feeding a length of tape into a substantially circular cup-shaped guide. Once the primary loop is formed, th eguide is lowered and released from the primary loop and the size of the loop is expanded. In FIG. 10 of the above-mentioned U.S. Pat. No. 4,079,667 there is disclosed a disk-shaped guide member formed of two half disks and wherein a guide surface is defined in the guide member for forming the primary loop. To enlarge the loop the two halves of the guide member are swivelled away from one another, to expose the strap which is then enlarged to fit the object.

Other published matter dealing with the subject matter of the present invention include U.S. Pat. Nos. 1.357,883; 3,146,694; 3,215,064; 3,442,732; 3,442,732; 3,447,447; 3,494,280; 3,554,844; 3,566,778; 3,636,861; 3,691,939; 3,718,526; 3,875,855; 3,916,779; 3,946,659; and 4,062,278; German Patent Application No. As 24 03 261; German Laid Open Patent Application No. 1 153 318; Great Britain Patent Specification No. 936,718; and Swiss Pat. No. 388 182.

However, the prior art dose not suggest or teach the simple structure of a binding apparatus in accordance with the present invention wherein a onee-piece guide member encloses an interior region, defines therein a guide surface, and is swivelable between first and second position, on and off a loop forming area on a bedplate. The one-piece guide member of the present invention is structurally simple and provides full and unimpeded access to the loop of tape and operates very reliably.

SUMMARY OF THE INVENTION

It is an object of the present invention to provide an automatic packing apparatus which is suitable for binding variously sized, including oversized, packages.

It is another object of the present invention to provide an automatic packing apparatus which forms a loop of binding tape through which a package to be bound could be inserted, wherein the loop is initially formed in a guide member and the guide member is retractable to allow enlarging the loop.

It is yet another object of the present invention to provide an automatic packing apparatus with a guide member having a simple construction and providing reliable and consistent operation.

The foregoing and other objects of the present invention are realized in accordance with the present invention by a novel method which includes the steps of deploying a one-piece guide member for forming an initial loop of packing tape on a work table. The size of the initial loop is reduced to allow the guide member to be retracted so as to provide obstruction free access to the loop of tape. Thereafter more tape is fed to increase the size of the loop to meet the needs of any given binding operation. The article to be bound is inserted through the loop and the tape is tighten around it. The ends of the tape are over-lapped and welded to one another. The tape is then cut off from a spool of tape from which the tape is fed.

An apparatus for realizing the above method includes a swivelably mounted guide member which is swivelled into position over the work table to form the initial loop of tape. The guide member is movable into position on the work table through the action of a solenoid.

A transport mechanism feeds the tape into the guide member. As the leading end of the tape passes through the guide member and reaches a predetermined position in the apparatus its presence is detected and a cam shaft is activated to cause the leading section of the tape to be pressed and held with the aid of a fixing cylinder. This creates an initial loop of tape where the tape extends along and abuts an interiorly located loop forming surface in the guide member.

Thereafter the transport mechsanism is reversed and the feeding end of the loop is pulled back to reduce the size of the loop, smaller than the guide member. The guide is then retracted by being swivelled off the work table.

The rotational direction of the transport mechanism is again reversed and the size of the loop of tape is increased to fit the object tnat is to be bound by the tape. Next, the object is inserted through the loop and its location there activates a work detection switch which produces an ON signal. The ON signal reverses the transport mechanism and this causes the tape to become tightly bound around the object. Further, the cam shaft is activated and it actuates a heating mechanism heats two overlapping ends of the loop of tape. The heated overlapped portions are welded to one another by a pressure welding cylinder. The loop of tape around the object is cut off by a cutter which is coupled to the pressure welding cylinder.

The overall operation of the transport mechanism is controlled by a control circuit which includes a gate control circuit which is responsive to a plurality of input signals derived from various switch contact input circuits. Timing control circuits are connected to the gate control circuit in a manner which is described more fully later herein.

Other features and advantages of the present invention will become apparent from the following description of the invention which refers to the accompanying drawings.

BRIEF DESCRIPTION OF THE DRAWINGS

FIG. 6 is a plane view of the guide member.

FIG. 7 is a block diagram of the control circuit section of the present invention.

FIGS. 8-1 and 8-2 are an electrical schematic of the control circuit section.

FIGS. 9-1 and 9-2 are is a timing diagram of control signals genterated by the present invention.

DETAILED DESCRIPTION OF A PREFERRED EMBODIMENT

Figure 1:
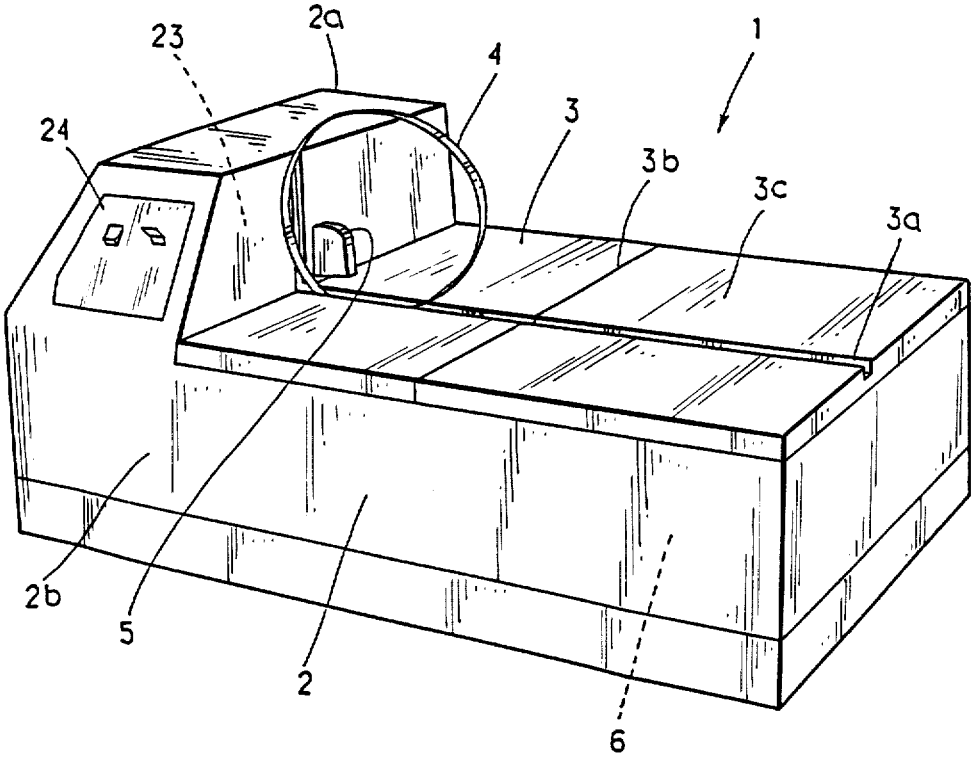
FIG. 1 is a perspective of the exterior of the automatic packaging apparatus according to the present invention.

Referring to FIG. 1, the automatic packaging apparatus 1 is accordance with the present invention includes a main housing 2 with a bed-plate 3 on one side thereof. The bed-plate 3 forms a work table surface. A loop of tape of thermoplastic material such as polypropylene, for example, is formed on the work table surface. An object to be packaged (not shown) is inserted through the loop and the object engages and activates a work detection switch 5 which is attached to the side of an extension 2*a* which is located on and projects from the left region of bed-plate 3. Activation of the detection switch 5, begins a cycle which results in the packing tape 4 being tightly bound around the object.

Bed-plate 3 covers the top of main housing 2 and contains a longitudinally extending groove 3*a* which is slightly wider than the width of packing tape 4. Packaging tape 4 emerges at a first position of grooves 3*a*, nearer extension 2*a*, forms a loop over bed-plate 3 and the leading end of the tape reenters groove 3*a* at a second position. Bed-plate 3 is formed of two sections which meet at lines 3*b*, including a right hand section 3*c* which is openable toward extension 2*a*.

A supply of the packing tape 4 is provided in housing 6, located under right hand section 3*c* of bed-plate 3. A control circuit section 23 which controls the overall operation of automatic packaging apparatus 1 is housed in the extension 1*a* of main housing 2, to the left of line 3*b*. A switch panel 24 containing power, switch and other circuit elements of the apparatus is attached to the front of extension 2*a*.

Figure 2:
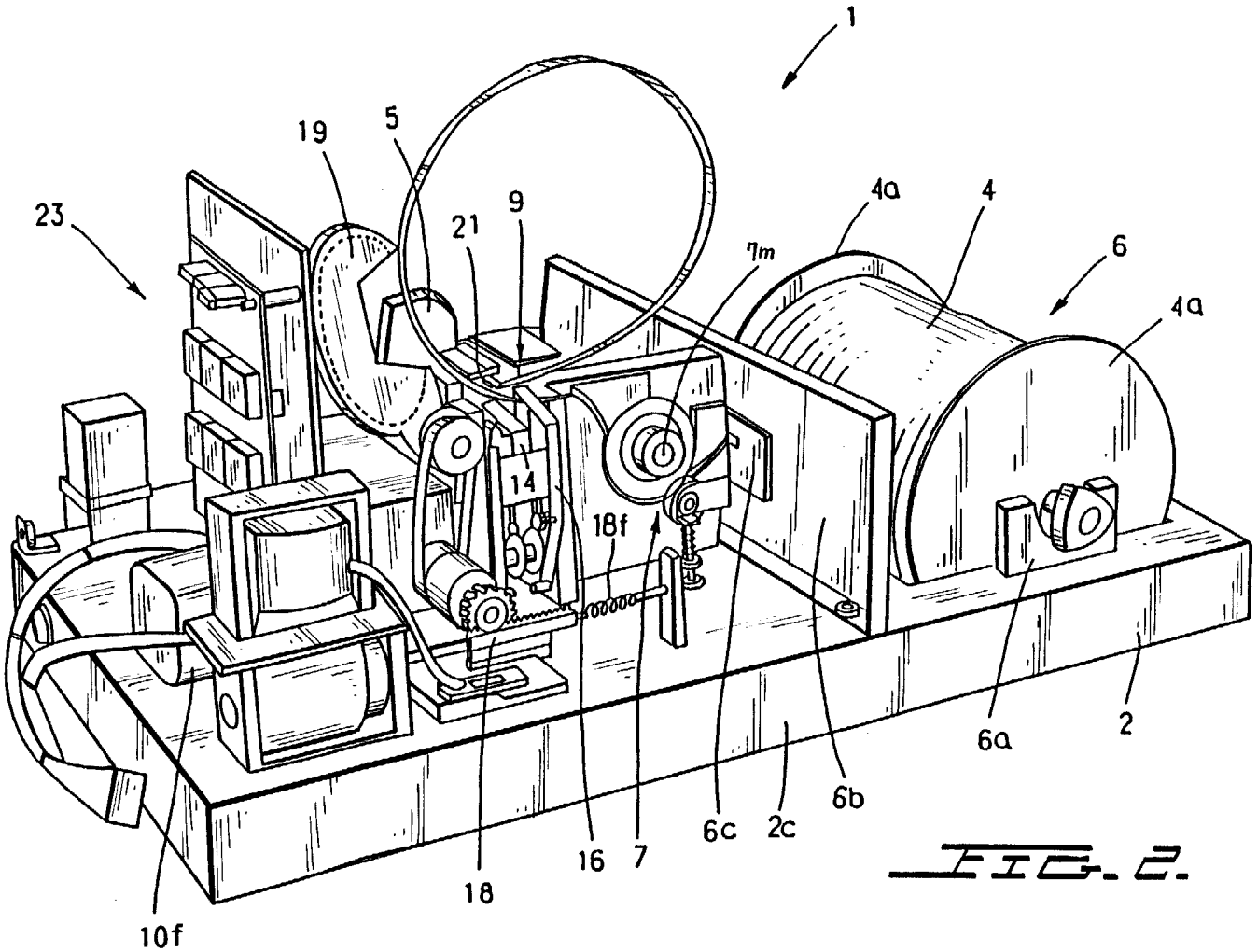
FIG. 2 is a perspective of the internal structure of the automatic packing apparatus with the bed-plate and main cover removed.

The interior mechanisms of the apparatus 1 of the present invention are depicted in FIG. 2, from which the main casing 2*b* and bed-plate 3 have been deleted. As seen in FIG. 2, the housing 6 supports a supply of the tape 4 at the right hand side chassis 2*c* of main housing 2. A roll of tape 4 is provided on tape holder 4*a* supported on frame 6*a* of housing 6. A partition 6*b* separates housing 6 from the other portions of the apparatus 1.

To the left of housing 6 are provided a tape transport mechanism 7, a pressure welding mechanism 9, a heating mechanism 16, a guide mechanism 18 and a control circuit section 23. The leading end of tape 4 passes through tape feeding opening 6*c* of partition 6*b* and is transported by transport mechanism 7 such that the leading end travels through guide member 19. Guide member 19 is positioned over bed-plate 3 and is part of guide mechanism 18. As the tape passes along the peripheral surfaces of guide 19 it is shaped into a loop, about the size of guide 19.

As the leading free end of tape 4 emerges from guide member 19 its presence is detected by tape position detection switch 21 and switch 21 issues a signal to indicate the detection. The signal activates a pressure welding mechanism 9 which is located beneath bed-plate 3 and the mechanism 9 engages and holds the leading end of tape 4 in place.

Next, the transporting direction of transport mechanism 7 is reversed with the result that the size of the loop of tape 4 is reduced and the tape 4 disengages from guide member 19. This allows guide 19 to be swivelled, in the plane of the loop of tape 4, toward and into extension 2*a*, exposing and providing obstruction free access to the loop which remains over the work table surface of bed-plate 3.

Once the guide member is safely in extension 2*a*, the direction of transport mechanism 7 is reversed again and this causes the size of the loop of tape 4 to increase as seen in FIG. 1, for example. The object to be packaged is inserted through the enlarged loop. The object strikes and activates work detection switch 5. Transport mechanism 7 responds by reversing its transporting direction and this tighten and binds the tape 4 around the object.

Control circuit section 23 senses that the tape 4 has been tightened sufficiently and proceeds to activate heating mechanism 16 which heats the over-lapped portions of tape 4. Pressure welding mechanism 9 is then activated to pressure weld the overlapped portions of tape 4. Cutter 14*c* which is located on pressure cylinder 14 cuts the excess of tape 4 and this completes the binding process.

The main components of automatic packaging apparatus 1 which were referred to above are now described in greater detail.

Figure 3:
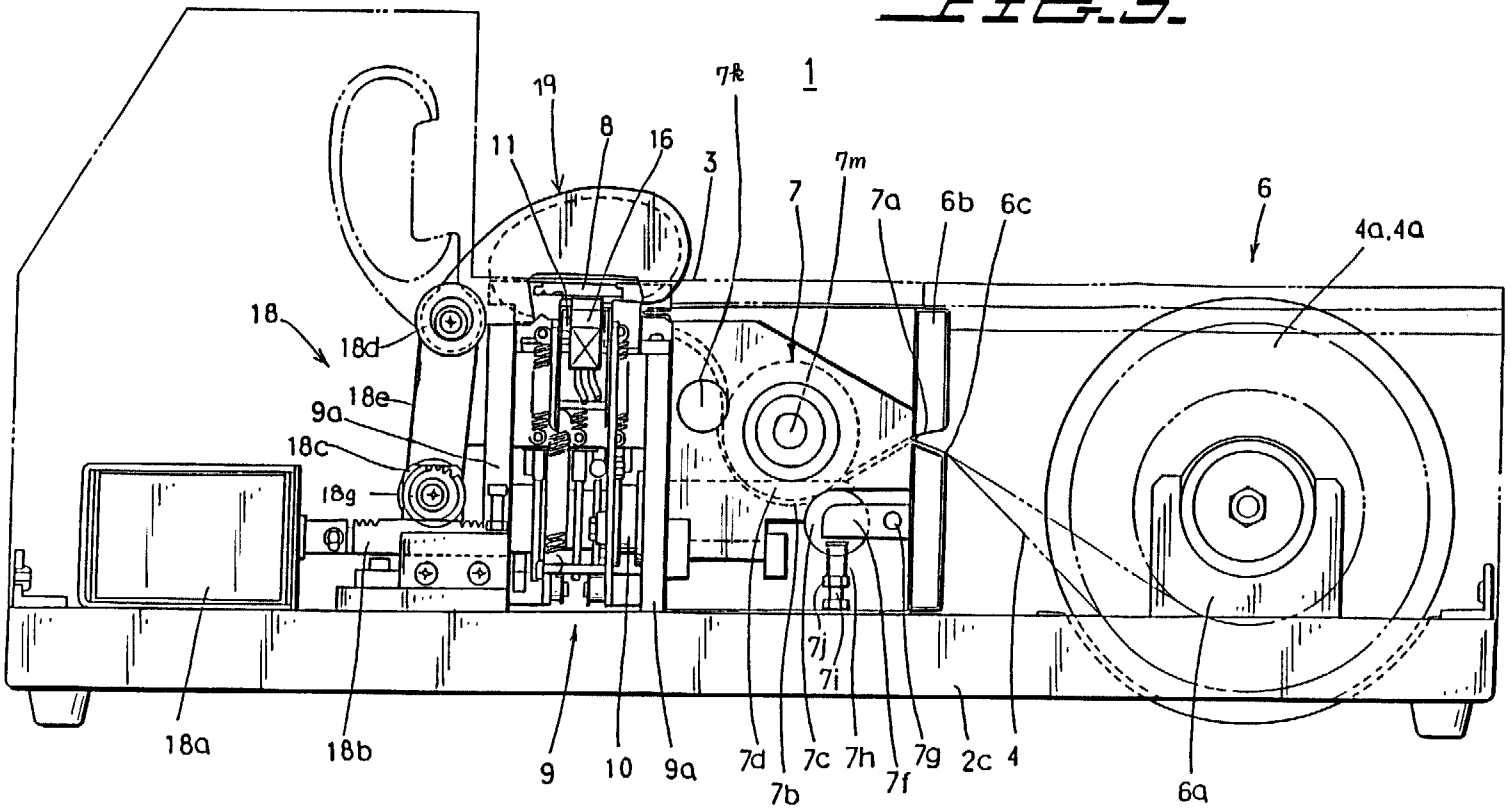
FIG. 3 is a side cross-sectional view of the apparatus.

Transport mechanism 7, as best seen in FIG. 3, comprises tape inlet 7a which is aligned to tape feeding opening 6c in portion 6b. A tape guide channel 7b extends from tape inlet 7a. Tape drive roller 7d is disposed at guide channel 7b and guide roller 7c contacts the peripheral surface of drive roller 7d. The tape is guided between drive roller 7d and guide roller 7c.

Downstream of the point of contact between drive roller 7d and guide roller 7c, guide channel 7b follows the peripheral surface of drive roller 7d such that the leading end of tape 4 is led to supply outlet 11 which is disposed below bed-plate 3.

Figure 4:
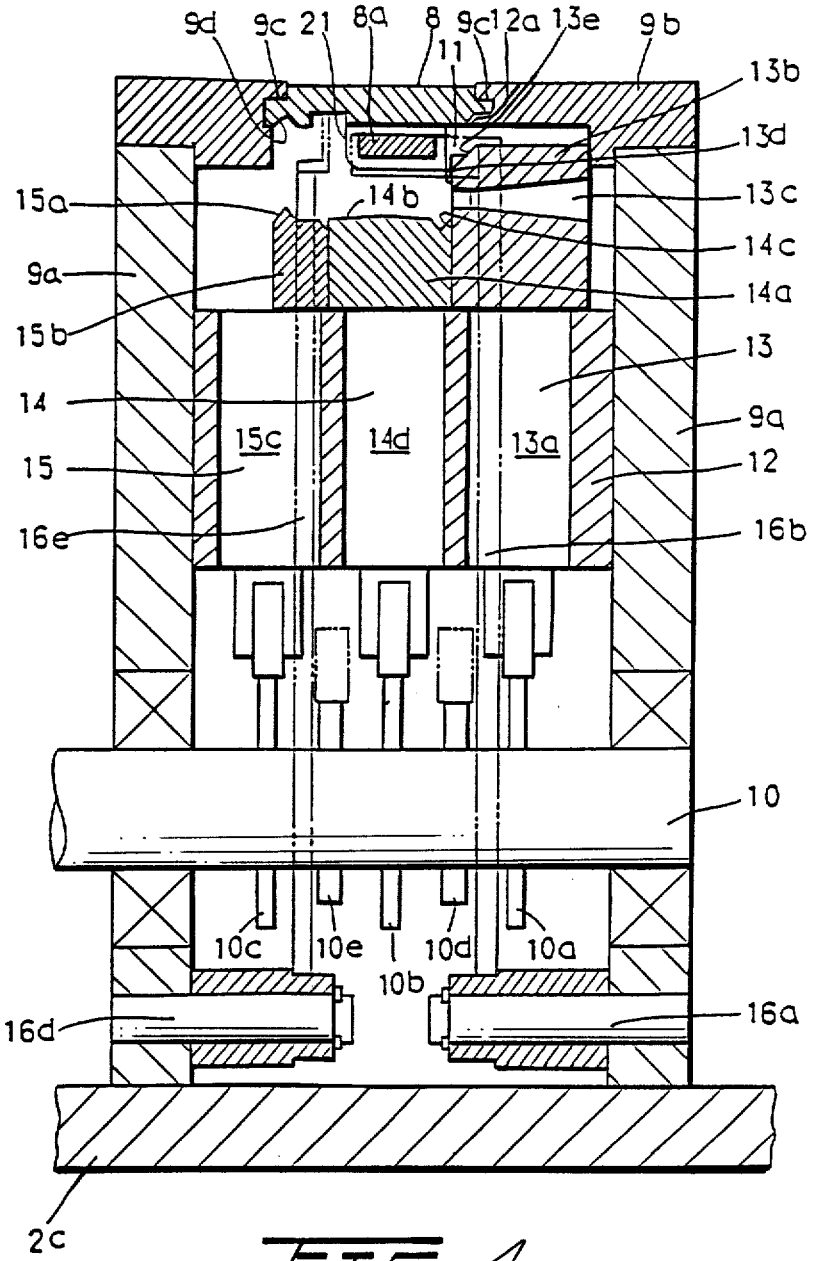
FIG. 4 is a front cross-sectional view of the pressure welding mechanism of the apparatus of the present invention.

As seen in FIG. 4, movable plate 8 is located over supply outlet 11 and the interior of supply outlet 11 is divided into an upper passage and a lower passage which are separated by member 8a. Member 8a is secured below movable plate 8. The distal end of guide channel 7b is connected to and communicates into the lower passage.

Figures 7, 8:
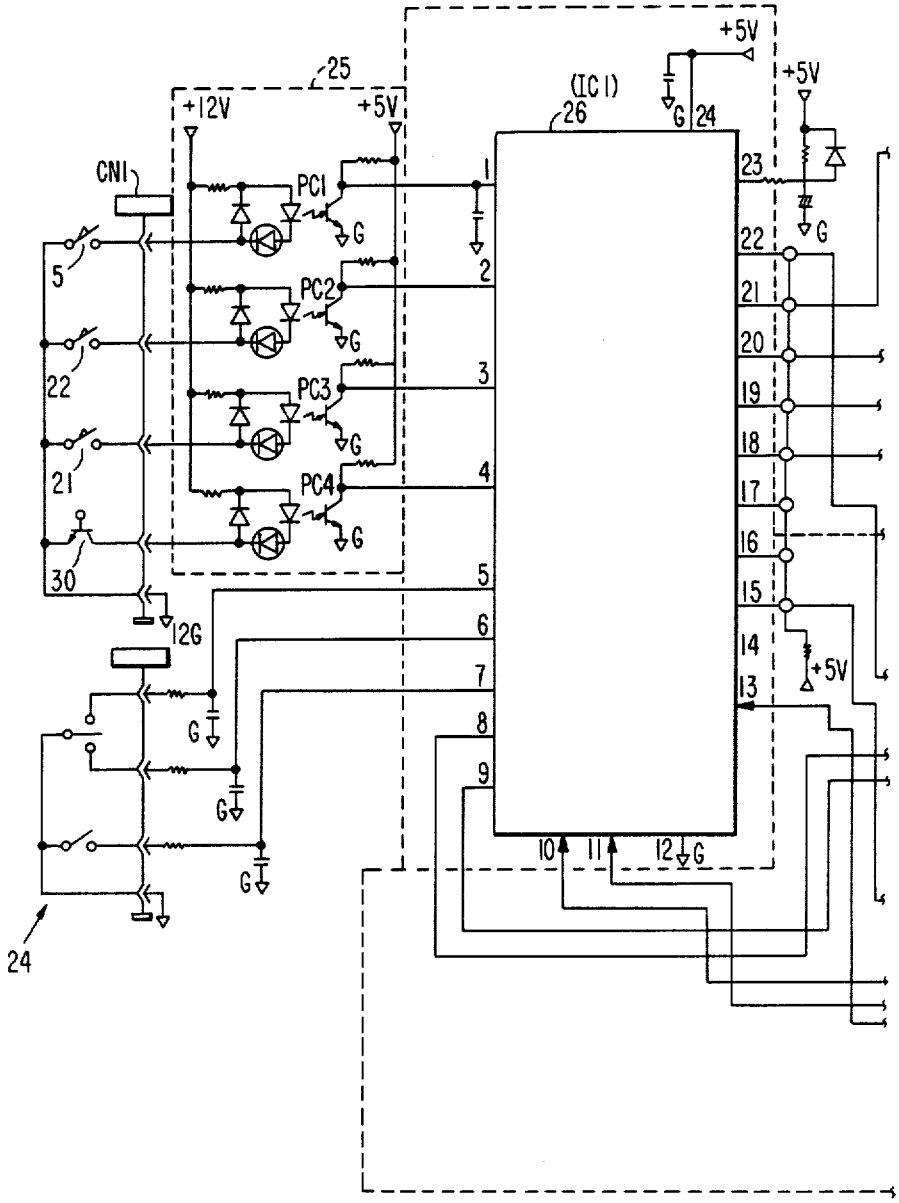
Figures 2, 8:
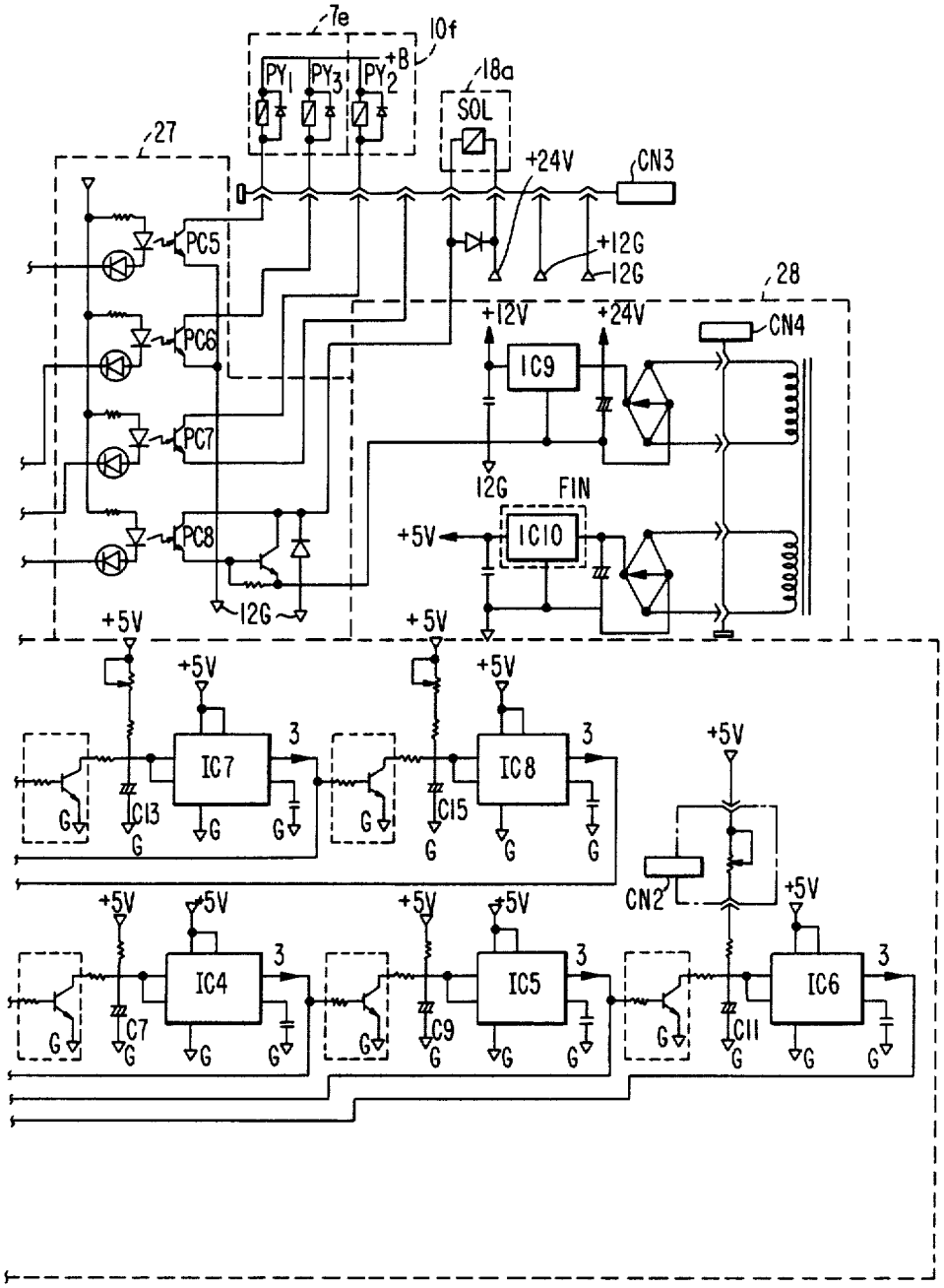

Referring back to FIG. 3, drive roller 7d is connected to shaft 7m coupled to motor 7e (FIG. 7). Upon issuance of certain command signals from control circuits 23, the motor 7e and shaft 7m rotate either clockwise (in a forward direction) or counterclockwise (producing a reverse motor turning direction).

Guide roller 7c is rotatably supported on support member 7f and the support member 7f is in turn swingably supported so that its position can be adjusted up and down by means of screw 7g which acts as a fulcrum for support member 7f. Coil spring 7h rest on bolt 7i which rests on chassis 2c. Coil spring 7h is biased to urge support member 7f and with it guide roller 7c upwardly and against drive roller 7d. Guide roller 7c therefore rotates with drive roller 7d and thereby the two rollers cooperate to transport packaging tape 4 in one or the other direction.

A nut 7j on bolt 7i allows adjustment of the spring force of coil spring 7h on guide rolller 7c. A sheet fabricated of clear resin is attached to the facing side of transport mechanism 7 and is attached thereto by screw 7k to prevent the packing tape 4 from leaving guide channel 7b.

Referring to FIG. 4, pressure welding mechanism 9 includes a cam shaft 10 passing through a lower region of side plates 9a which extend vertically from chassis 2c. A cylinder block 12 and a coupling member 9b appear above cam shaft 10. An engagement slot 9c is formed at the upper surface of coupling member 9b and movable plate 8 which is disposed directly beneath bed-plate 3 is mounted to slide back and forth in engagement slot 9c, in a direction in and out relative to the plane of FIG. 4. Intermediate member 8a, which is located below movable plate 8, is similarly slidable back and forth in the same direction as movable plate 8. Both movable plate 8 and intermediate member 8a are urged forwardly in a direction out of the plane of FIG. 4 by spring (not show).

Movable plate 8 and intermediate member 8a are movable against the force exerted by the above-mentioned springs by cam plate 10e of cam shaft 10 as will be described.

Cylinder block 12 which is fixed as shown relative to the two side plates 9a is provided with three cylinder bores. The cylinder bores accommodate, respectively, a typing cylinder 13, a pressure welding/cutting cylinder 14 and a fixing cylinder 15. Each of the cylinders 13, 14 and 15 is vertically slidable in its respective cylinder bore. The structure and function of these cylinders is as follows.

Tying cylinder 13 has a main cylinder member 13a and an integrally formed upper soild block 13b. Tape passage 13c has sloping walls passing through block 13b for defining a passage for tape 4. An uppper blade 13d is provided on the upper left edge of block 13b and the top of trying cylinder 13 contains a step section 13e. As the leading end of tape 4 arrives at outlet 11, it is detected by position detection switch 21. Detection of the leading end of tape 4 initiates a series of action which result in stoppage of the feeding of tape 4 and the clamping of the free leading end of tape 4 between step section 13e and movable plate 8.

Pressure welding/cutting cylinder 14 includes a main cylinder memeber 14d which is slidable through the centrally located cylinder bore of cylinder 12 and a block section 14a. The top surface of block section 14a comprises a flat section 14b. Flat section 14b is suitable for pressing packaging tape 4 against the underside of movable plate 8 and further supports a cutter 14c which is disposed to the right and which abuts the left hand side of tying cylinder 13. Cutter 14c cooperates with upper blade 13d of tying cylinder 13 to cut the tape 4 from the tape supply.

The third fixing cylinder 15 is disposed to the left of pressure welding/cutting cylinder 14 and includes main cylinder member 15c having a block 15b on its top and a projection 15a which projects from the top of block 15b. Projection 15a is located such that it is selectively engageable with groove section 9d on the underside of movable plate 8 to clamp packaging tape 4 at a second location.

Each of the main cylinder members 13a, 14d and 15c has a respective roller attached to its lower end and a respective cam plate 10a, 10b and 10c affixed to cam shaft 10. The cam plates 10a, 10b and 10c are urged into resilient contact with cam shaft 10 by springs (not shown). Cam shaft 10 is coupled to a motor 10f through a train of gear wheels (FIG. 2).

A datum detection circuit 22 is disposed above cam shaft 10 veriify the datum (reference angular position) of cam shaft 10 and to provide information of the angular position of cam shaft 10. The cam plate 10d, located between cam plate 10a and 10b, operates heating mechanism 16 and another cam plate 10e, located between cam plate 10b and 10e, operates supply outlet 11 of movable plate 8.

Figure 5:
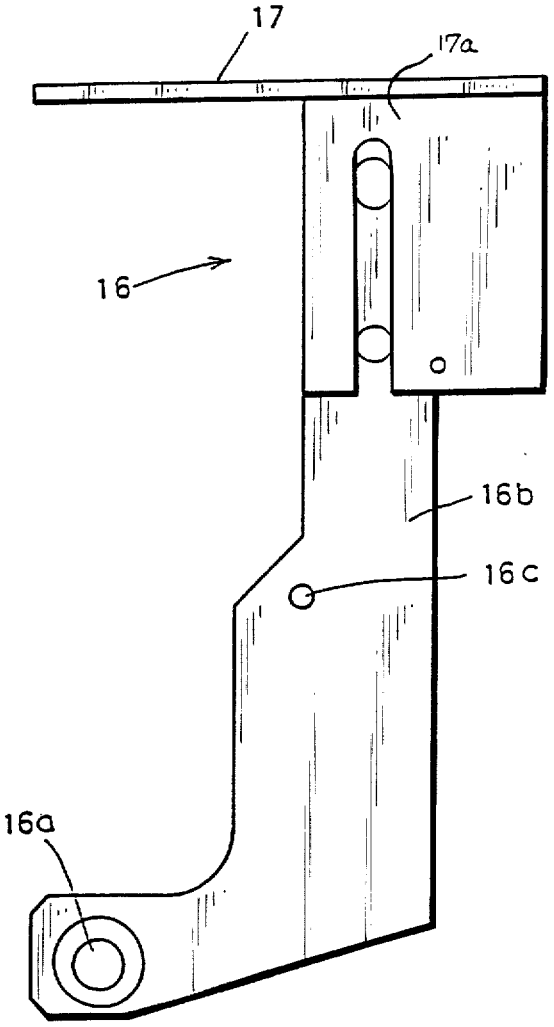
FIG. 5 is a side view of the heating mechanism of the present invention.

Heating mechanism 16, as seen in FIG. 5, includes bearing shaft 16a which projects inwardly from side plates 9a under shaft 10, a shank 16b supported on bearing shaft 16a, and a heater member 17 at the top of shank 16b. Heater member 17 is slab shaped and houses a permanently heated heating device in a case 17a which is attached to the underside thereof. A bearing hole 16c which is instrumental for supporting a roller is located at the center of shank 16b. A roller attached to the inner side of bearing hole 16c is in pressure contact with cam plate 10d through the force exerted thereon by a spring (not shown).

Movable plate 8 is movable with the aid of a moving mechanism which is similar to the above-described cam mechanusm of heating mechanism 16. Specifically, the moving mechanism for movable plate 8 includes a bearing shaft 16d located oppositely to bearing shaft 16a (FIG. 4), a shank 16e which slides on bearing shaft 16d, a roller which is attached to an intermediate section of shank 16e, and a spring which cooperates with the roller top provide a pressure contact with cam plate 10e on cam shaft 10. As a result, rotation of cam plate 10e causes back and forth rocking motion about bearing shaft 16d.

The top of shank 16e communicates inwardly with respect to the plane of FIG. 4 and is coupled to movable plate 8 and to intermediate member 8a. The rocking movement of shank 16e causes movable plate 8 anad intermediate member 8a to move inwardly relative to the plane of FIG. 4. Shank 16b of heating mechanism 16 operates in the same manner. Heater member 17 is moved by shank 16b between the overlapping surfaces of packaging tape 4, immediately intermediate member 8a is removed from between the overlapping surfaces. Also, simultaneously with the completion of the welding of tape 4 by pressure welding/cutting cylinder 14, movable plate 8 is moved inwardly and out of the way through the turning action of cam plate 10e. This enables the object being packaged to be removed from bed-plate 3.

Referring to FIG. 3, the guide mechanism 18 is located to the left of pressure welding mechanism 9. Guide mechanism 18 guides packaging tape 4 as it is conveyed from transport mechanism 7 and shaped it into a loop, over bed-plate 3. Chassis 2c provides a platform which supports a solenoid 18a, a rack 18b which is coupled to an actuating free end of solenoid 18a, a coil spring 18f (FIG. 2) which is biased to urge rack 18b to the right, and a toothed belt pulley 18c which is mounted coaxially with a gear wheel 18g that meshes with rack 18b. A second, similarly sized, toothed belt pulley 18d is rotatably supported on left-hand side plate 9a of pressure welding mechanism 9 and a belt 18e couples pulleys 18d and 18c to one another. Guide 19 is mounted to swivel about the spindle on which the second toothed belt pulley 18d is supported.

As seen in FIG. 6, guide 19 is comprised of two flat and transparent side plates 19b, 19b. The upper peripheral side edge of guide 19 is crescent shaped and the oppositely disposed peripheral side edge contains a cut section 19a which is designed to project above and to cover movable plate 8, when guide 19 is in its position over bed-plate 3. The spindle which supports the second toothed belt pulley 18d passes through shaft hole 19c of guide 19.

A guide surface 20 is defined between the flat side plates 19b, 19b. The width of guide surface 20 is slightly larger than the width of packaging tape 4 and the guide surface is crescent shaped. The leading end of packaging tape 4 enters guide 19 through the left hand side thereof and packaging tape 4 moves along guide surface 20 to form an initial loop of tape.

Normally, rack 18b is urged to the right by coil spring 18f and this positions guide 19 in the double dotted line, upright position, as illustrated in FIG. 3. However, to form the initial loop, soleniod 18a is energized by a signal which issues from control circuit section 23. Rack 18b is then pulled to the left and the pinion engaging rack 18b is rotated clockwise. The clockwise rotation of the pinion turns toothed belt pulley 18c and its rotation is communicated by means of belt 18e to toothed belt pulley 18d. The net result is that guide 19 is swivelled into position over bed-plate 3 (as depicted in the soild line drawing of guide 19 FIG. 3).

While guide 19 is in position over bed-plate 3, the left and right sides of its cut out portion 19a rest in the groove 3a of bed-plate 3. The left side of guide 19 is in alignment with the lower part of supply outlet 11.

Control circuit section 23, illustrared in FIG. 7, includes a contact input circuit 25 which receives several switch contact input signals including a signal from work detection switch 5, and signals from datum detection switch 22, tape position detection switch 21 and tape tighten signal 30. Contact input circuit 25 conditions and converts the input signals into output signals which are supplied to gate control circuit 26 (ICl).

A switch panel 24 provides several additional contact input signals which bypass contact input circuit 25 and are coupled directly into gate control circuit 26.

Gate control circuit 26 is a programmable logic arry gate circuit which is programmed to detect the input signals which it receives and to output various output signals in response. These output signals are outputted to switch circuit 27 and to program timers IC4, IC5, IC6, IC7, and IC8. The program timers produce a sequentially controlled procedure for automatically operating packaging apparatus 1. Switch circuit 27 responds to gate control circuit 26 by out-putting signals which are connected to and control motoer 7e, motor 10f, and solenoid 18a.

Program timer IC7 is connected to output terminal 22 of gate control circuit 26 and its function is to control the timing of the commands which control solenoid 18a and, therefore, indirectly the positioning of guide 19. program timer IC7 contains a time constant circuit C13 which delays energization of solenoid 18a to prevent guide 19 from being moved to its position on bed-plate 3 while the object to be packaged is still in the process of being removed from bed-plate 3. The delay factor provided by time constant circuit C13 is adjustable.

Program timer circuit IC8 is connected to the output of program timer circuit IC7 and its function is to control the timing of the commands which rotate transport motor 7e for transporting tape 4 into and through guide 19. Program timer IC8 includes a time constant circuit C15 which produces a delay that delays actuation of motor 7e, so that the motor 7e does not begin to turn in a forward direction before solenoid 18a has completed the process of securely positioning guide 19 over bed-plate 3. The time delay factor of time constant circuit C15 is adjustable with the aid of a variable resistor.

Program timer IC4 is connected to output terminal 15 of gate control circuit 26 and its function is to control the timing of commands which stop the reverse motor rotation of motor 7e. A time constant circuit C7 in program timer IC4 sets the time when contraction of the initial loop formed in guide 19 begin. The initial loop is contracted to enable guide 19 to be withdrawn from over bed-plate 3 without snagging tape 4.

Program timer IC5 is connected to the output of program timer IC4 and its function is to control the timing of commands which control forward rotation of motor 7e as during the process wherein more of the tape 4 is fed to the loop in order to enlarge it. The time constant circuit C9 of program timer IC5 provides a time delay to allow guide 19 to move into extension 2a before the forward rotation of motor 7e is started.

Program timer IC6 is connected to program timer IC5 and it function is to control the timing of commands which control the time duration during which motor 7e rotates forwardly, to enlarge the loop of tape to allow insertion into the loop of larger objects. When program timer IC6 reaches its set time delay it outputs a control signal which is connnected to input terminal 13 of gate control circuit 26 and this causes all of the circuits to reset. Like the other program timers, program timer IC6 includes a time constant circuit C11 that controls the time period during which motor 7e rotates forwardly. The time delay factor of time constant circuit C11 is adjustable and by adjusting the time delay it is possible to adjust the loop size.

Power for operating the circuits of apparatus 1 is supplied from power supply circuit 28 which supplies several voltages including 5 volts, 12 volts and 24 voltage outputs.

Figures 1, 9:
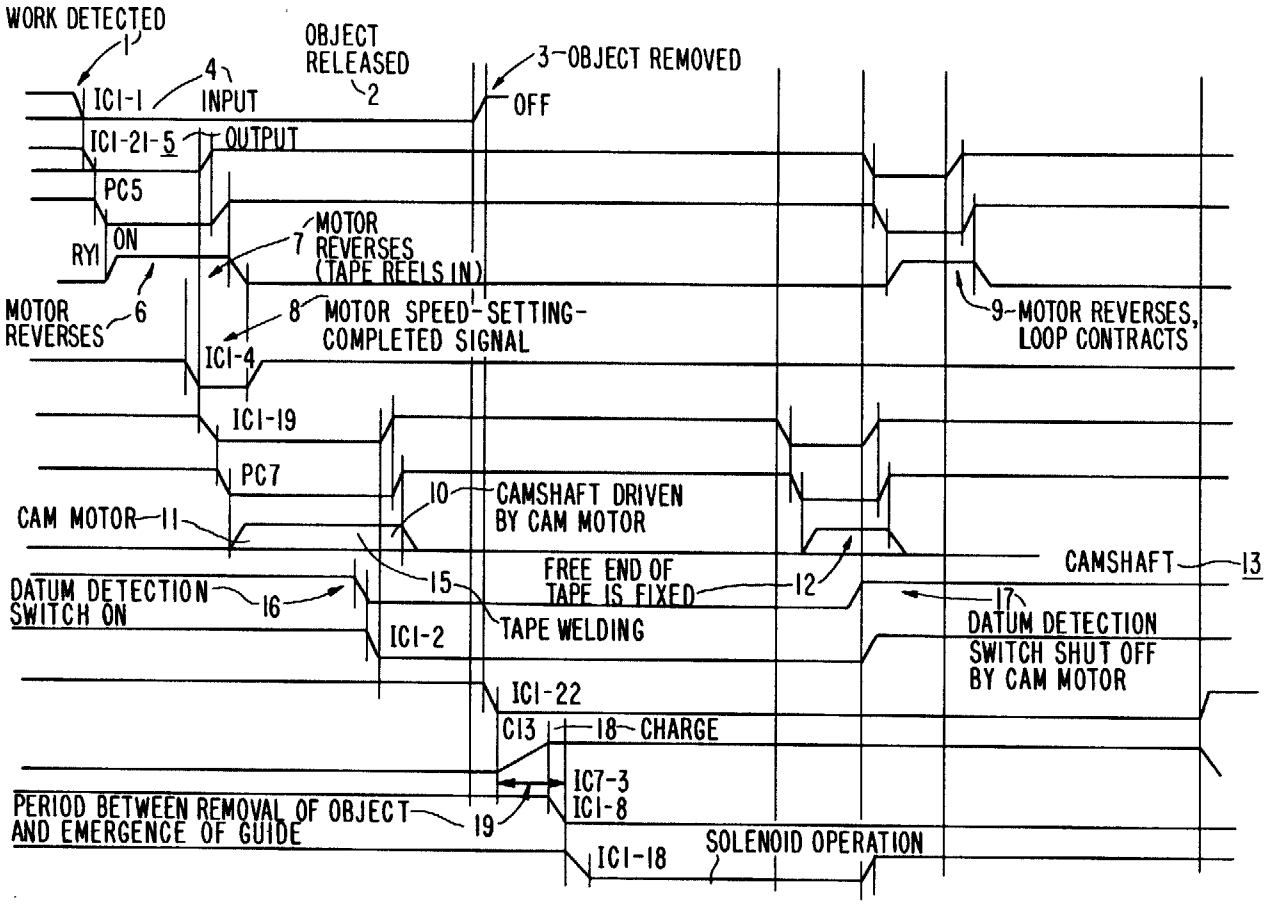
Figures 2, 9:
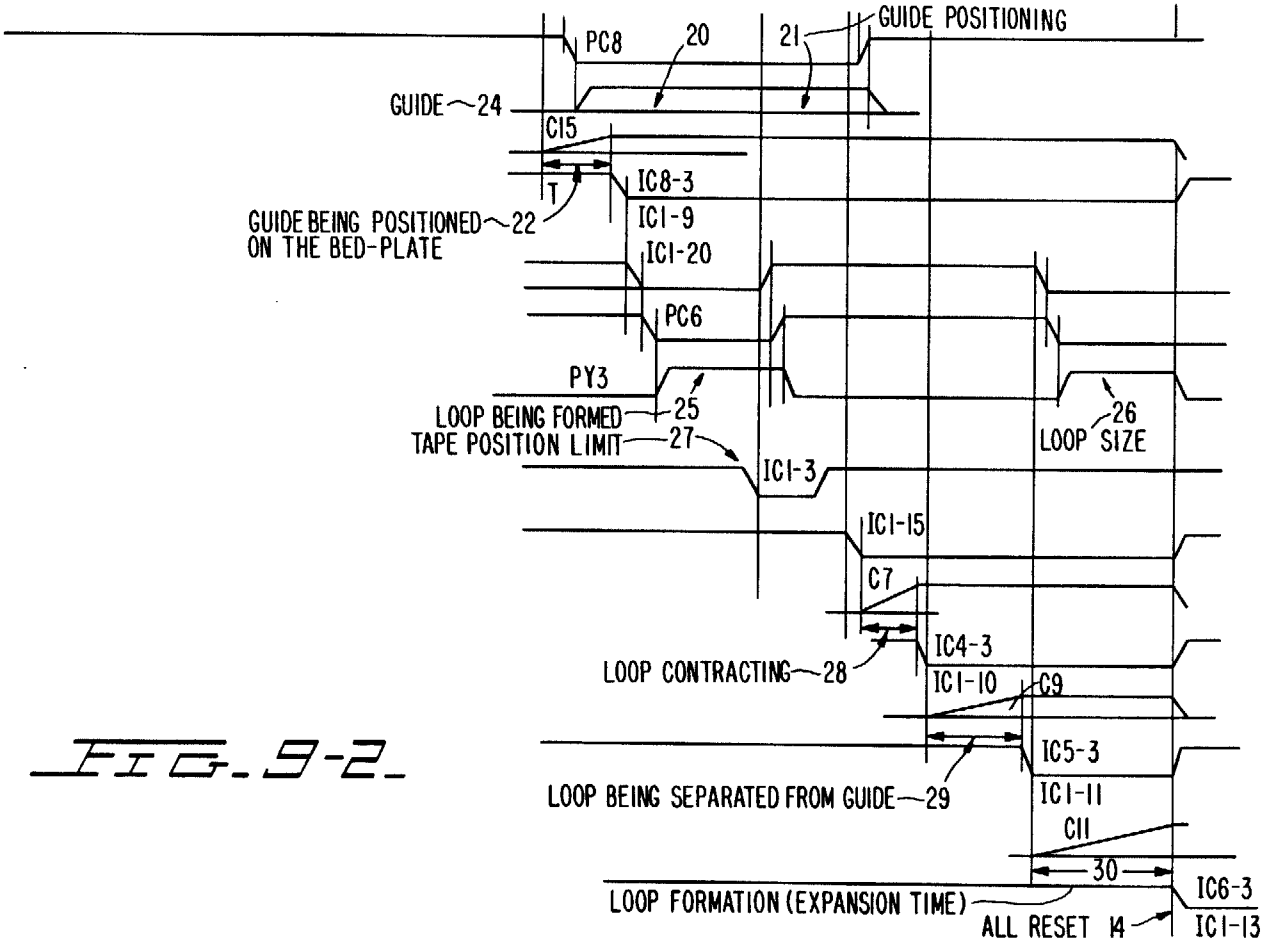

The description of the sequence of operations of automatic packaging apparatus 1 is further expaned by reference to the schematic of control circuit section 23 in FIGS. 8-1 and 8-2 and by reference to FIGS. 9-1 and 9-2 which depict the timing signals associated with control circuit section 23.

The binding process begins with the insertion of an object to be packaged into a previously formed large loop of tape provided on bed-plate 3. The object strikes work detection switch 5 and the switch outputs a signal to input terminal 1 of gate control circuit 26 via contact input circuit 25. In response, gate control circuit 26 outputs an output signal at its output 21 which activates a reversing relay $PY_1$ that causes motor 7e to rotate in a reverse direction. The output signal of gate control circuit 26 is coupled to reversing $PY_1$ via switch circuit 27 which contains photocoupler PC5. The reverse rotation of motor 7e causes tape 4 to be tightened around the object to be packaged.

Tape 4 is eventually tightened and the load on the output shaft of motor 7e is increased and this reduces the rotational speed of motor 7e. Once the rotational speed of motor 7e reaches below a predetermined value, motor speed detection circuit (not shown) outputs a tape tightened signal 30 and that signal is applied to contact input circuit 25. Contact input circuit 25 buffers and interfaces the tape tightened signal to input terminal 4 of gate control circuit 26 and in response an output signal appears at output terminal 19 of gate control circuit 26 which output signal is coupled, via switch circuit 27 and photocoupler PC7, to cam motor 10f. This activates motor 10f and as it rotates cam shaft 10 is rotated to a position whiich results in the tape 4 which is disposed in the lower part of supply outlet 11 becoming fixed in place by being clamped between projection 15a of fixing cylinder 15 and groove portion 9d of movable plate 8.

Cam shaft 10 further actuates heating mechanism 16 such that heater member 17 is positioned to apply heat to overlapped portions of tape 4.

As cam shaft 10 continues to turn, heating member 17 is retracted from the overlapped portions of tape 4 and the pressure welding cylinder 14 is actuated by the cam shaft 10. The ovelapped portions of tape 4 are then pressure welded between the lower surface of movable plate 8 and the flat portion 14b on pressure cylinder 14. At the same time tape 4 is cut with cutter 14c and upper blade 13d *which is associated with tying cylinder 13.*

Cam plate 10e is rotate by cam shaft 10 and as cam shaft 10 returns to is original position shank 16 and movable plate 8 move in a direction into the planae of FIG. 4. When cam shaft 10 reaches its rest position, tying cylinder 13, pressure welding cylinder 14 and fixing cylinder 15 are all at their lowest positions. Also, as cam shaft 10 returns to its rest position, a signal issues from detection switch 22 which is coupled to input terminal 2 of gate control circuit 26. In response, gate control circuit 26 outputs, at terminal 19 thereof, an output signal to cam motor 10f, via switch circuit 27 and photocoupler PC7. The output signal deactivates relay $PY^2$ and this stops cam motor 10f.

The object which has been bound by the tape is then removed from bed-plate 3 and this causes work detection switch 5 to switch off and to turn off its output signal. This occurrence is sensed at terminal 1 of gate control circuit 26. In response, an output signal appears at output terminal 22 of gate control circuit 26 which is supplied to program timer IC7 via time constant circuit C13.

After the delay period of time constant circuit C13, program timer IC7 sipplies its output signal to input terminal 8 of gate control circuit 26 and to time constant circuit C15 of program timer IC8. Gate control circuit 26 responds by supplying, at output put terminal 18 thereof, and output signal for solenoid 18a, via switch circuit 27 and photocoupler PC8. This energizes solenoid 18a to drive guide mechanism 18 to position guide 19 over bed-plate 3.

Note that time constant circuit C13 of program timer IC7 delays the positioning of guide 19 over bed-plate 3 to provide sufficient time for removing the object from bed-plate 3, to prevent risk to the operator or object.

The output of program timer IC7 is supplied to program timer IC8 via time constant circuit C15. Thus, after the time delay of time constant circuit C15, program timer IC8 provides its output signal to input terminal 9 of gate control circuit 26. In response, gate control circuit 26 outputs, at terminal 20 thereof, a signal for transport motor 7e which actuates forward relay $PY_3$, via switch circuit 27 and photocoupler PC6. Motor 7e responds by turning in a direction which feeds tape 4 through guide 19. The delay time constant circuit C15 provides the necessary time delay that assures that the tape 4 is fed into guide 19 only after the guide has been securely positioned over bed-plate 3.

After a sufficient lenght of tape has been fed into guide 19, the leading end of the tape contacts tape positions detection switch 21. In response, switch 21 provides an input signal to input terminal 3 of gate control circuit 26, via contact input circuit 25. Gate control circuit 26 then outputs, at terminal 19 thereof, an output signal to relay $PY_2$, via switch circuit 27/photocoupler PC7. Cam motor 10f and its cam shaft 10 begin to turn and the rotation of the cam shaft 10 moves portion 13e of tying cylinder 13 and the moveable plate 8 such that the leading end of tape 4 is clamped in postion directly before supply outlet 11. At the same time, the signal from datum detection switch 22 switches off. The switching off of the signal is sensed at input terminal 2 of gate control circuit 26 and in response the output signal at terminal 19 of gate control circuit 26 changes states to turn off cam motor 10f.

Further in response to the turning off of the signal from datum detection switch 22, gate control circuit 26 controls its output signal at output terminal 18 to inhibit further energization of solenoid 18a. The signal at output terminal 18 propagates via switch circuit 27 and photocoupler PC8.

The turning off of datum detection switch 22 also activated the signal at output terminal 21 of gate control circuit 26 which is supplied to relay $PY_1$ via switch circuit 27 and photocoupler PC5. Activation of relay $PY_1$ causes motor 7e to turn in its reverse direction and the loop of tape in guide 19 begins to contract.

Still further in response to the turning off of datum detection switch 22 gate control circuit 26 produces an output signal at its output terminal 15 and that signal is supplied to program timer IC4, via time constabt circuit C7. The output of program timer IC4 is supplied to input terminal 10 of gate control circuit 26 and the latter circuit controls the output signal at terminal 21 to turn off relay $PY_1$. This ends the reverse rotation of motor 7e and fixes the size of the initial loop of tape. The time duration during which the size of tape 4 is being contracted is set by the delay produced by timer constant circuit C7.

The previously mentioned de-energization of solenoid 18a causes guide 19 to swivel in response to the force exerted thereon by coil spring 18f and the guide 19 separtes smoothly from the reduced size loop of tape.

The output of program timer IC4 is also supplied to program timer IC5 via time constant circuit C9. Program timer IC5 produces its output signal subsequent to the time delay which is interposed by time constant circuit C9. The output signal of program time IC5 occurs after a time period which is sufficient to allow guide 19 to become fully separated from the tape 4. The output signal is supplied to input terminal 11 of gate control circuit 26 and the latter circuit responds by controlling its output terminal 20 to activate relay $PY_3$, via switch 27/photocoupler PC6. Motor 7e begins to rotate forwardly to feed more tape and to increase the size of the loop of tape.

The size of the final loop is controlled by program timer IC6 which is connected to the output of program timer IC5 via time constant circuit C11. After the time delay of time constant circuit C11, program timer IC6 produces its output signal which it supplies to reset terminal 13 of gate control circuit 26. The activation of the reset terminal 13 resets gate control circuit 26 to an initial state in its internal program.

In the reset state, gate control circuit 26 provides an output signal at terminal 20 which activates relay $PY_3$, via switch circuit 27/photocoupler PC6. This inhibits further rotation of motor 7e and fixes the size of the loop of tape 4. The delay provided by time constant C11 is large enough to produce a loop size that allows large objects to be inserted through the loop. This completes the process at a stage where a loop of tape is ready for packaging the next object.

A monitor switch of switch panel 24 provides an input to gate control circuit 26 which is effective for increasing the size of the loop further, by driving transport motor 7e forwardly. Similarly, if the tightness of the tape around the package is inadequate, it is possible to employ the monitor switch to reverse the rotation of motor 7e and to produce a tighter binding. Further adjustment is possible in the event that the timing of cam shaft 10 is off to allow cam monitor switch to adjust the timing as desired.

Although the present invention has been described in relation to a specific embodiment thereof, many other variations and modifications and other uses will become apparent to those skilled in the art. It is preferred, therefore, that the present invention be limited not by the specific disclosure herein, but only by the appended claims.

What is claimed is:

1. A binding apparatus for binding an elongate tape around an object, comprising:

a housing having a generally horizontally extending bed-plate for supporting an object to be packaged thereon, a loop forming space comprised of the space extending vertically from the bed-plate, and means for supplying binding tape to the loop forming space on the bed-plate;

a one-piece guide member defining an enclosed region and having an arc-shaped interior guiding surface which is effective for shaping binding tape passing through the guide member into a loop, the guide member having a swivel mount and being swivelable between a first position, at which the guide member is disposed on the bed-plate and within the loop forming space, and a second position at which the guide member is disposed outside the loop forming space;

guide member swivelling means for swivelling the guide member between its first and second positions along a plane vertical to the bed-plate;

tape guiding means for guiding a leading portion of the binding tape from the tape supplying means into the guide member to form an initial loop of tape in the guide member, while the guide member is at its first position;

tape conveying means for selectively conveying the tape either in a forward or in a reverse direction;

means for actuating the guide member swivelling means to move the guide member away from the first position to the second position of the guide member;

means for enlarging the initial loop after retraction of the guide member; and binding means for tightening the enlarged loop of tape around the object, attaching a leading end and a trailing end of the loop to one another, and severing the loop of tape from the tape supplying means whereby the loop of tape remains tightly bound around the object.

2. The apparatus of claim 1, wherein the swivelling means for the guide member comprises a swivelling spindle for the guide member and a pulley coupled to the spindle and means for rotating the pulley in first and second directions to respectively position the guide member off and on the bed-plate.

3. The apparatus of claim 2, in which the swivelling means further comprises a toothed rack movable, generally along a straight line, between first and second positions and means for coupling the rack to the pulley in a manner whereby the movement of the rack rotates the pulley.

4. The apparatus of claim 3, further comprising a solenoid for moving the rack.

5. The apparatus of claim 1, including a longitudinal groove in the bed-plate for enabling the tape to pass through the bed-plate and wherein the guide member is comprised of two generally symmetrical guide member sections which are joined to one another to form therebetween the guiding surface along one predetermined peripheral region therein and a cut out section formed oppositely to the guiding surface and locatable over the groove in the bed-plate.

6. The apparatus of claim 5, including means for dislocating at least a portion of the bed-plate relative to the housing of the apparatus in a manner which is effective to enable a roll of binding tape to be inserted into the housing.

7. The apparatus of claim 1, including means for sensing that an object has been inserted through the loop of tape and automatic means, responsive to the sensing means, for automatically activating the binding means to bind the loop of tape around the object and to sever the tape from the tape supplying means and for automatically actuating the guide member, the tape guiding means and the tape conveying means to form a fresh loop of tape on the bed-plate, upon removal of the object from the bed-plate.

8. The apparatus of claim 7, wherein the automatic means comprises a programmable gate logic control circuit.

9. The apparatus of claim 8, wherein the gate logic control circuit comprises:

a programmable device having a plurality of input terminals and a plurality of output terminals;

a first interface device for interfacing input signals to the input terminals;

a second interface device for interfacing the output signals of the control circuit to the conveying means for the tape and to the binding means; and a plurality of timing circuits coupled to the programmable device for providing timing signals for effecting programmed control of the apparatus.

10. The apparatus of claim 1, in which the tape guiding means includes a first clamping means for clamping the leading end of the tape as it emerges from the guide member, a second clamping means for clamping a trailing end of the loop of tape and means for overlapping a section of the trailing end of the tape with the leading end.

11. The apparatus of claim 10, further comprising means for heating the overlapped portions of the tape.

12. The apparatus of claim 11, further comprising a pressure welding means for pressure welding the overlapped heated portions of the tape.

13. The apparatus of claim 12, in which the binding means comprises a rotatable cam shaft, a tying cylinder, a fixing cylinder and a welding cylinder, the cylinders being coupled to the cam shaft and being respectively operable for clamping the leading and the trailing ends of the tape and for pressure welding the tape.

14. The apparatus of claim 1, wherein the tape supply means comprises a roll of thermoplastic tape.

15. The apparatus of claim 14, wherein the thermoplastic tape is comprised of polypropylene.

16. A method for binding a tape around an object, comprising:

locating, by swivelling, a one-piece guide member having a loop shaped passage defined therein onto a bed-plate having a horizontally extending work surface for placing the object thereon, the bed-plate defining an interior region below the work surface and a loop forming space comprised of the space above the bed-plate;

guiding a binding tape forwardly from the interior region into the guide member such that a leading end of the tape enters the guide member, traverses the loop shaped passage, emerges from the guide member and reenters the interior region;

clamping the leading end of the tape;

reducing the size of the loop of tape by changing the feeding direction of the tape;

moving the guide member along a plane vertical to the work surface and outside the loop forming space to provide obstruction free access to the loop of tape;

feeding additional tape to the loop of tape to enlarge it beyond the size of the passage;

inserting an object through the enlarged loop of tape; and tightening the loop of tape around the object, overlapping the leading end of the tape with a trailing portion of the tape while holding the loop of tape tightly around the object, joining the overlapped tape portions, and severing the tape disposed around the object from a source of tape from which the binding tape is supplied.

17. The method of claim 16, wherein the guide member is comprised of a one-piece, swivellably mounted, tape guiding element and wherein the steps of moving the guide member onto the bed-plate comprise swivelling the guide member between the first and second positions respectively on and off the work surface of the bed-plate.

* * * * *